US006176040B1

(12) United States Patent
Sugihara

(10) Patent No.: US 6,176,040 B1
(45) Date of Patent: Jan. 23, 2001

(54) SLOTTED LEVER DEVICE FOR KEEPING AN AUTOMOTIVE DOOR IN AN OPEN POSITION

(75) Inventor: Noriyuki Sugihara, Hamamatsu (JP)

(73) Assignee: Suzuki Motor Corporation, Hamamatsu (JP)

( * ) Notice: Under 35 U.S.C. 154(b), the term of this patent shall be extended for 0 days.

(21) Appl. No.: 09/271,911

(22) Filed: Mar. 18, 1999

(30) Foreign Application Priority Data

Mar. 19, 1998 (JP) ..... 10-070387

(51) Int. Cl.[7] ..... E05B 17/28; E05F 5/06

(52) U.S. Cl. ..... 49/394; 16/86 C; 292/DIG. 15

(58) Field of Search ..... 49/394, 502; 16/86 R, 16/86 A, 86 C; 292/DIG. 15, 338, 262

(56) References Cited

U.S. PATENT DOCUMENTS

| | | | | |
|---|---|---|---|---|
| 1,120,169 | * | 12/1914 | Tabor | 292/266 |
| 1,547,674 | * | 7/1925 | Nelson | 292/266 |
| 3,254,452 | * | 6/1966 | Costantini et al. | 49/386 |
| 3,337,253 | * | 8/1967 | Laukzemis | 292/268 |
| 4,692,960 | * | 9/1987 | Jozefczak | 16/86 A |
| 4,751,766 | * | 6/1988 | Fahs et al. | 16/332 |
| 5,002,320 | * | 3/1991 | Richardson | 292/275 |
| 5,173,991 | * | 12/1992 | Carswell | 16/86 A |
| 5,727,287 | * | 3/1998 | Hosken et al. | 16/82 |
| 5,765,268 | * | 6/1998 | MacKirdy | 27/18 |
| 5,862,570 | * | 1/1999 | Lezuch et al. | 16/82 |

FOREIGN PATENT DOCUMENTS

| | | | | |
|---|---|---|---|---|
| 383818 | * | 1/1965 | (CH) | 292/262 |
| 190576 | * | 10/1907 | (DE) | 292/338 |
| 3-23501 | | 5/1991 | (JP) . | |

* cited by examiner

*Primary Examiner*—Daniel P. Stodola
*Assistant Examiner*—Gregory J. Strimbu
(74) *Attorney, Agent, or Firm*—Finnegan, Henderson, Farabow, Garrett & Dunner, L.L.P.

(57) ABSTRACT

An automotive door stopper device has a decreased vertical dimension to facilitate the arrangement of the device within a door opening of a vehicle body, and prevents the entrance of foreign matter and the accumulation of dirt and dust in the device. The automotive door stopper device includes a lever having a base end portion rotatably attached to a side of a door, an engagement pin fixed to the vehicle body for guiding the lever, and a braking mechanism for restraining movement of the lever. A planar surface of the lever faces the vertical direction. A case is provided which houses the braking mechanism and covers a portion of the lever. The case is secured to the vehicle body by the engagement pin. The automotive door stopper device allows the door to be stopped in an intermediate position between the open and closed positions.

6 Claims, 4 Drawing Sheets

SLOTTED LEVER DEVICE FOR KEEPING AN AUTOMOTIVE DOOR IN AN OPEN POSITION

BACKGROUND OF THE INVENTION

1. Field of the Invention

The present invention relates to an automotive door-open stopper device used for a door rotatably attached to a vehicle body with hinges or the like.

2. Description of the Related Art

FIG. 7 is an exploded perspective view of a conventional automotive door-open stopper device, which has been disclosed in Japanese Utility Model Publication No. 3-23501 (No. 23501/1991). This automotive door-open stopper device has a guide arm 1 pivotally carried on a back door, not shown, and an engagement pin 2 which is supported at the edge portion of door opening on the vehicle body side and engages with the guide arm 1. The guide arm 1 is formed by lapping opposite end portions 4 of an elastic band-shaped member 3, which is formed by bending with a plate face facing sideward, and by connecting an annular support plate 5 to the opposite end portions with rivets 6. The support plate 5 is pivotally supported on the back door via a rotating shaft 7, and a bent portion 8 of the band-shaped member 3 serves as a rotating end of the guide arm 1.

The engagement pin 2 is inserted between opposing faces of the band-shaped member 3. The band-shaped member 3 has first protrusions 11 in the vicinity of the bent portion 8 and second protrusions 12 at a halfway position in the lengthwise direction, which are formed so as to project inward. The band-shaped member 3 is slidable with respect to the engagement pin 2 at a parallel portion 9 between the rotating shaft 7 and the second protrusions 12, and the sliding motion with respect to the engagement pin 2 is elastically regulated by these protrusions 11 and 12.

Here, the case where the back door is opened will be explained by way of example. As the back door is opened, the guide arm 1 slides with respect to the engagement pin 2. When the second protrusions 12 comes into contact with the engagement pin 2 as the result of this sliding motion, the second protrusions 12 once regulate the opening operation of back door elastically. When the opening operation of back door is further carried on, the second protrusions 12 are pushed wide, and they get over the engagement pin 2. Thereby, the engagement pin 2 is held elastically between the first protrusions 11 and the second protrusions 12, and the back door is kept in a half-opened state.

SUMMARY OF THE INVENTION

However, in the aforementioned conventional door-open stopper device, since the band-shaped member 3 is used as an element of the guide arm in which the plate face thereof faces sideward, there is a limit to the decrease in the vertical dimension, which makes the layout difficult. Also, since the whole structure of the engagement pin 2, the guide arm 1, and the like is exposed, there arises a problem in that foreign matters may enter or dirt and dust may accumulate.

The present invention solves the above problems with the conventional stopper device, and accordingly an object of the present invention is to provide an automotive door-open stopper device capable of decreasing the vertical dimension to facilitate the layout and preventing the entrance of foreign matters and the accumulation of dirt and dust.

To achieve the above object, the present invention provides an automotive door-open stopper device comprising a movable member whose base end portion is rotatably attached to the door side, an engagement pin, which is fixed to the vehicle body side, for guiding the movable member, and a braking mechanism for restraining the movement of the movable member, all of which are disposed under a door, the engagement pin guiding the movable member, and the door being stopped at a halfway position between the open and closed positions by using the braking mechanism, characterized in that a case is provided which contains the braking mechanism and is also used as a cover for covering the movable member, and the case is mounted on the vehicle body side by the engagement of the engagement pin.

Since a case is provided which contains the braking mechanism and is also used as a cover for covering the movable member, and the case is mounted on the vehicle body side by the engagement of the engagement pin, the present invention achieves an effect that the saving of the installation manpower and the decreased cost can be achieved. Also, since the movable member is a plate-shaped lever in which a plate face faces in the vertical direction, the present invention has advantages that the vertical dimension of part can be decreased, a notch need not be provided at the lower end etc. of the door to avoid the interference with the lever, the stopper device can be mounted in a limited space, the deformation strength in the transverse direction can easily be increased, and the entrance of foreign matters and the accumulation of dirt and dust can securely prevented by providing an extending portion extending in the lengthwise direction of the movable member on the case.

DETAILED DESCRIPTION OF PREFERRED EMBODIMENTS

Figure 1:
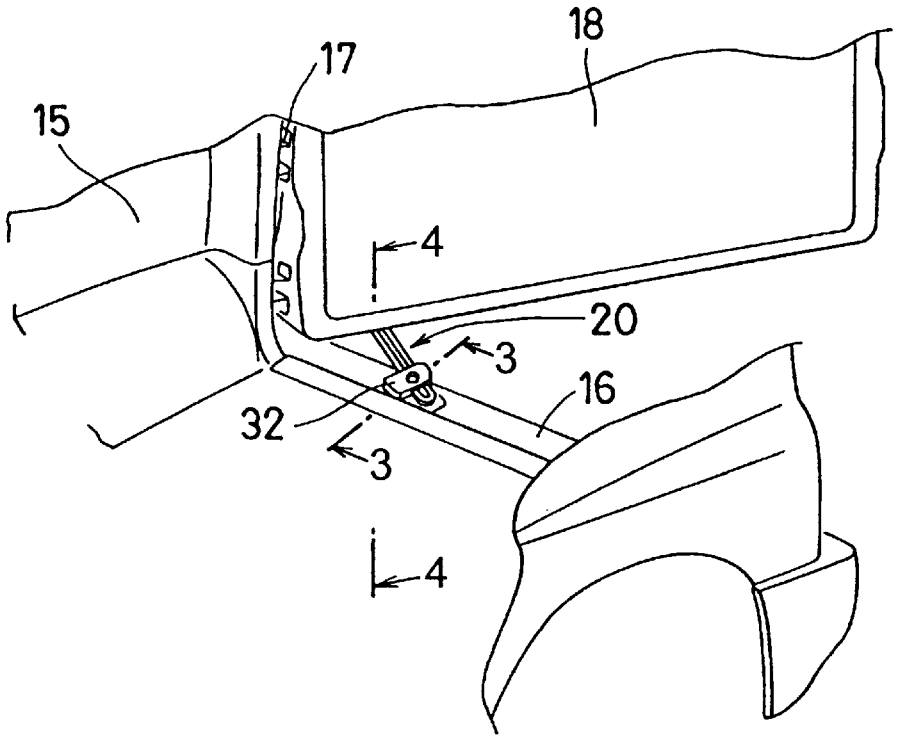
FIG. 1 is a perspective view showing the rear part of an automobile to which an automotive door-open stopper device in accordance with an embodiment of the present invention is applied.
Figure 2:
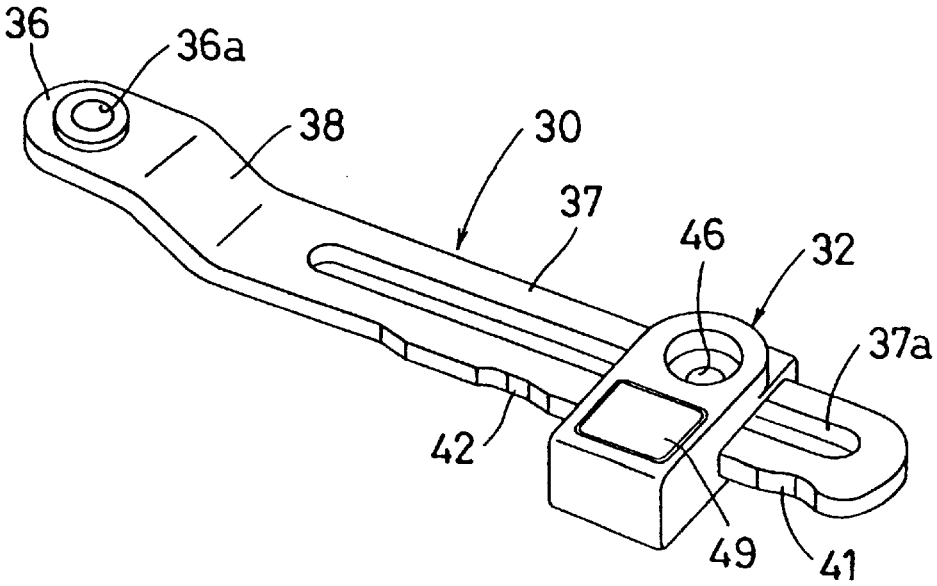
FIG. 2 is an enlarged perspective view of the door-open stopper device shown in FIG. 1.

An automotive door-open stopper device in accordance with an embodiment of the present invention will be described in detail with reference to the accompanying drawings. FIG. 1 is a perspective view showing the rear part of an automobile to which an automotive door-open stopper device in accordance with an embodiment of the present invention is applied, and FIG. 2 is an enlarged perspective view of the door-open stopper device shown in FIG. 1. An automobile in accordance with this embodiment has a rear bumper 16 fixed to the rearmost part of a vehicle body 15 and a back door 18 attached rotatably with hinges 17, and is equipped with a door-open stopper device 20 between the rear bumper 16 and the back door 18.

Figure 3:
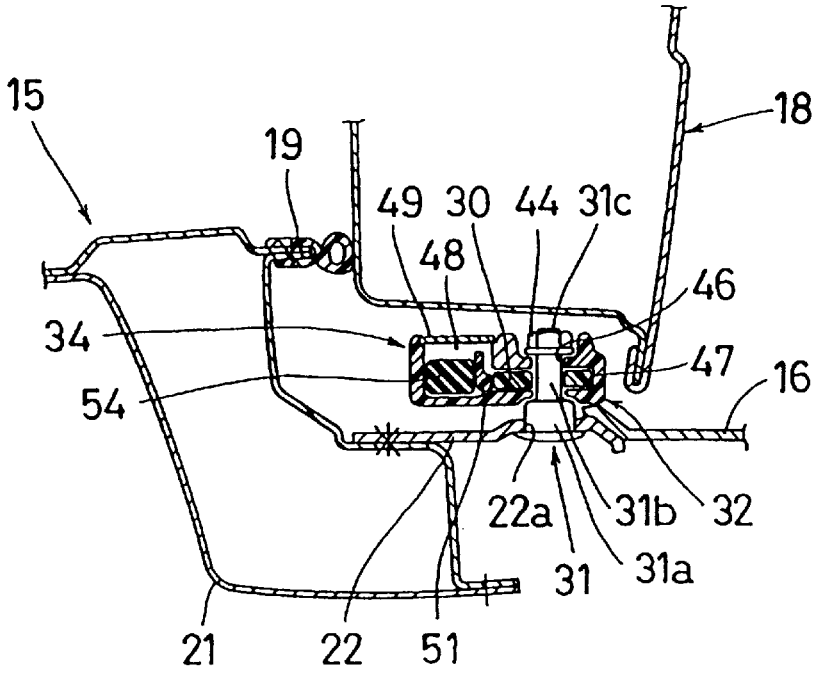
FIG. 3 is a sectional view taken along the line 3—3 of FIG. 1.

As shown in FIG. 3, the rear bumper 16 is fixed to the vehicle body 15 via a bracket 22 fixed to a tail member 21.

Figure 4:
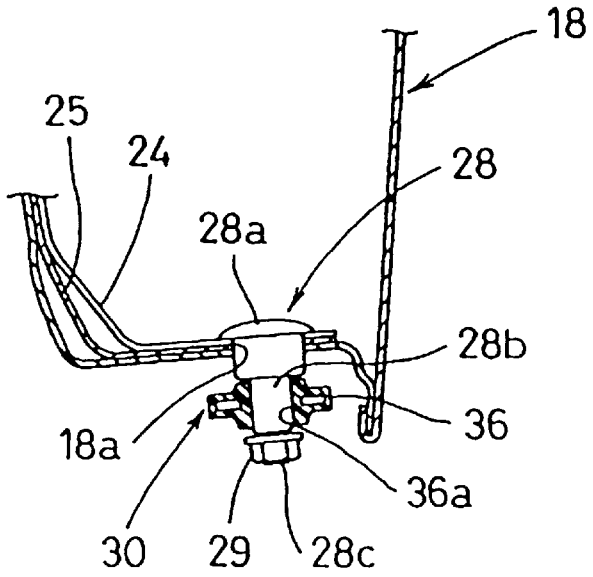
FIG. 4 is a sectional view taken along the line 1—4 of FIG. 1, showing a portion of a back door.

The bracket 22 is formed with a mounting hole 22*a*. As shown in FIG. 4, the back door 18 has a pivotally supporting pin 28 disposed at the lowermost part thereof where a gusset 24 and a reinforcement 25 lap on each other, and comes into contact with a weather strip 19 fitted at the edge of the vehicle body 15 when being closed, as shown in FIG. 3. The pivotally supporting pin 28 integrally has a head 28*a*, a shank 28*b*, and an externally threaded portion 28*c*. The pin 28 passes through a through hole 18*a* formed at the lower end of the back door 18, the externally threaded portion 28*c* projecting downward, and the head 28*a* prevents the pin 28 from coming off.

A door-open stopper device 20 is provided with a lever 30 attached to the side of the back door 18, serving as a rotatable movable member, an engagement pin 31 which is fixed on the side of the vehicle body 15 to guide the lever 30, a case 32 which is mounted on the side of the vehicle body 15 by engaging with the engagement pin 31, and a braking mechanism 34 for restraining the movement of the lever 30, all of which are disposed under the back door 18. The case 32 contains the braking mechanism 34, and also has a function as a cover for covering the lever 30. The door-open stopper device 20 guides the lever 30 with the engagement pin 31, and allows the back door to stop at a halfway position between the open and closed positions by using the braking mechanism 34.

As shown in FIG. 2, the lever 30, having a plate shape in which a plate face faces in the vertical direction, includes a pivotally supporting portion 36 on the base end side and an engagement portion 37 on the tip end side. A slant portion 38 inclining downward toward the tip end side is provided between the pivotally supporting portion 36 and the engagement portion 37. A through hole 36*a* is formed in the pivotally supporting portion 36, and an elongated guide hole 37*a* continuous in the lengthwise direction is formed in the range from one end of the engagement portion 37 to the vicinity of the slant portion 38. The slant portion 38 is provided to align the engagement portion 37 with the height position of the engagement pin 31 with respect to the pivotally supporting portion 36, and to avoid the interference with the lower end of the back door 18.

Also, the lever 30 has a first recess 41 in the vicinity of the tip end and a second recess 42 at an intermediate position formed on one side edge face along the lengthwise direction of the engagement portion 37. The lever 30 is attached to the back door 18 so as to be rotatable around the pivotally supporting pin 28 (see FIG. 4) mounted to the back door 18 by inserting the pivotally supporting pin 28 into the through hole 36*a* and by threading a nut 29 onto the externally threaded portion 28*c* of the pin 28.

As shown in FIG. 3, the engagement pin 31, integrally having a head 31*a*, a shank 31*b*, and an externally threaded portion 31*c*, is inserted into the mounting hole 22*a* formed in the bracket 22 for attaching the rear bumper 16, with the externally threaded portion 31*c* projecting upward and the shank 31*b* passing through the case 32 and the engagement portion 37 of the lever 30.

Figure 5:
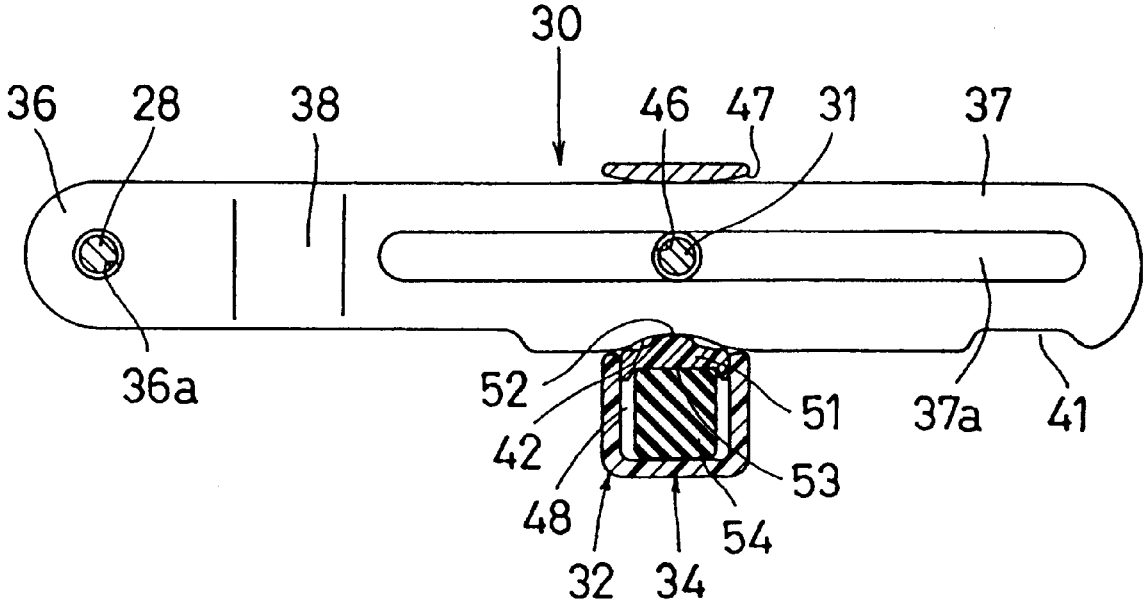
FIG. 5 is a sectional view of the door-open stopper device shown in FIG. 2, being cut along a plane.

As shown in FIGS. 3 and 5, the case 32 has a circular through hole 46 formed in the vertical direction and a rectangular through hole 47 formed in the transverse direction. A storage chamber 48 for containing the braking mechanism 34 is formed on the side facing both of the recesses 41 and 42 of the engagement portion 37 of the lever 30 passing through the rectangular through hole 47. The upper opening of the storage chamber 48 of the case 32 is closed with a cap 49. The cap 49 has an elastic locking claw (not shown), and fitted to the case 32 by locking the locking claw to a protrusion (not shown) etc. on the inside wall surface of the case 32. The cap 49 can be removed by unlocking the locking claw.

The case 32, which is prevented from coming off by passing the engagement pin 31 through the circular through hole 46 and threading a nut 44 onto the externally threaded portion 31*c* of the engagement pin 31, is mounted on the side of the vehicle body 15 so as to be rotatable around the engagement pin 31. The case 32 contains the braking mechanism 34 in the storage chamber 48, and also covers the shank 31*b* of the engagement pin 31 and the engagement portion 37 of the lever 30. Thus, the case 32 rotates around the engagement pin 31 in association with the rotation of the lever 30.

As shown in FIGS. 3 and 5, the braking mechanism 34 has a shoe 51 being in contact with the lever 30 and a cushioning member 54 located between the inside wall surface of the case 32 and the shoe 51. The shoe 51 has a convex surface 52 being in contact with the side edge face of the lever 30 and a concave surface opposing to the convex surface 52. The shoe 51 receives a pressing force on the concave surface 53 by means of the cushioning member 54. When the convex surface 52 comes into contact with the first recess 41 or the second recess 42 of the lever 30, it elastically restrains the sliding motion of the lever 30 with respect to the engagement pin 31. When the convex surface 52 comes into contact with the second recess 42, it stops the back door 18 in a half-opened state. The cushioning member 54, consisting of a rectangular prism made of elastic rubber, is disposed between the side wall inside surface of the case 32 and the concave surface 53 of the shoe 51 to push the shoe 51 on the side edge face of the lever 30 with a restoring force.

The following is a description of the operation of the automotive door-open stopper device in accordance with the above-described embodiment of the present invention. When the back door 18 is closed, the pivotally supporting pin 28 lies at a position closest to the engagement pin 31. When the back door 18 begins opening around the hinge 17, the pivotally supporting pin 28 moves on an arc with the hinge 17 being the center together with the back door 18, going away from the engagement pin 31. At this time, the lever 30 moves by being guided by the engagement pin 31 passing through the elongated guide hole 37*a*. Also, when the second recess 42 on the side edge face of the lever 30 reaches the position of the shoe 51 pushed by the cushioning member 54, the braking mechanism 34 fulfills the intermediate stop function at the recess 42, so that the back door 18 is stopped in a half-opened state.

When the opening operation of the back door 18 is further carried on and the first recess 41 on the side edge face of the lever 30 reaches the position of the shoe 51 pushed by the cushioning member 54, the braking mechanism 34 fulfills the end stop function at the first recess 41, so that the back door 18 is stopped in a full-opened state. At this time, the pivotally supporting pin 28 lies at a position farthest from the engagement pin 31. When the back door 18 is closed from the full-opened state, the stopper device operates in the reverse direction.

According to the door-open stopper device 20 in accordance with the above embodiment of the present invention, since the cushioning member 54 and the shoe 51 are used as the braking mechanism 34 of the lever 30 and the cushioning member 54 pushes the shoe 51 on the side edge face of the lever 30 having the recesses 41 and 42, the elastic intermediate stop function can be provided. Also, since the cap 49 is removable, the shoe 51 and the cushioning member 54 can easily be replaced or adjusted. Since the case 32 is rotatably attached to the side of the vehicle body 15 by using the engagement pin 31, the installation construction is simple. Further, since the pressing force is applied to the lever 30 from only one side in the substantially horizontal and transverse direction by means of the shoe 51, the vertical dimension of part can be reduced, so that the device can be mounted in a limited space, and the downsizing of parts and the reduction in the number of necessary parts can be achieved.

Figure 6:
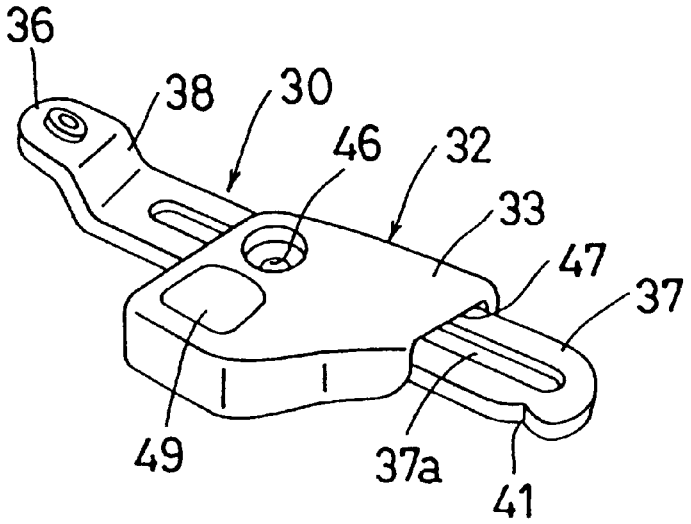
FIG. 6 is a perspective view showing a modification of the embodiment of the present invention.
Figure 7:
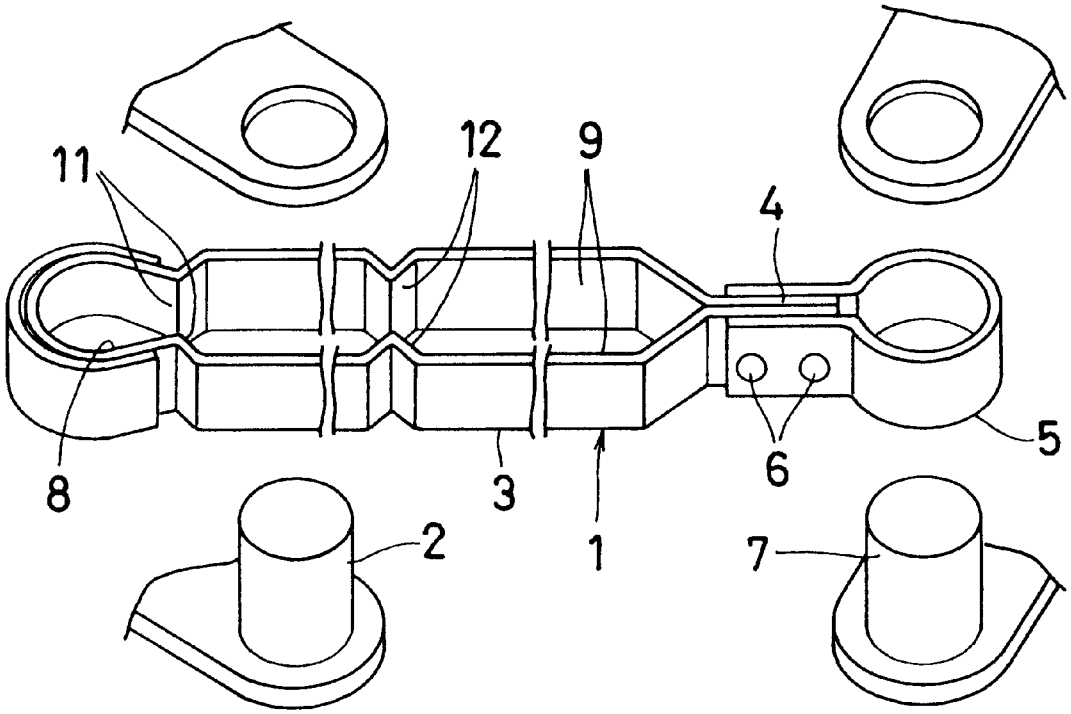
FIG.7 (RELATED ART)
FIG. 7 is an exploded perspective view of a conventional automotive door-open stopper device.

FIG. 6 is a perspective view of a door-open stopper device in accordance with a modification of the above embodiment of the present invention. This door-open stopper device 20 differs from the stopper device of the above-described embodiment in that it integrally has an extending portion 33 extending in the lengthwise direction of the lever 30 and the extending portion 33 extensively covers the engagement portion 37 of the lever 30. According to this stopper device, since a more extensive portion of the engagement portion 37 of the lever 30 is covered by the case 32, the entrance of foreign matters and the accumulation of dirt and dust can be prevented more securely. Since other elements are the same as those of the above embodiment, the same reference numerals are applied to the same elements, and the duplicate explanation of these elements is omitted.

The present invention is not limited to the above-described embodiment, and various changes and modifications can be made. For example, the stopper device in accordance with the present invention may be applied to a side door, and also may be applicable to not only a single-leafed hinged door but also a double-leafed hinged door. Also, three or more recesses of the lever 30 may be provided if necessary, and a spring may be used in place of the cushioning member 54 made of elastic rubber.

Also, as the material for the lever 30, case 32, and shoe 51, any of ABS (acrylonitrile-butadiene styrene), PMMA (polymethacrylic acid), PF (phenol), PS (polystyrene), POM (polyacetal), PA (polyamide), and the like can be selected arbitrarily.

What is claimed is:

1. An automotive door-open stopper device comprising:

a movable plate lever having a central slot and a side end face having first and second recesses;

an engagement pin engaging said slot to guide said lever; and a braking mechanism for restraining movement of said lever, the braking mechanism including a shoe having a convex surface abutting the side end face of the lever;

wherein said braking mechanism is contained in a case which covers a portion of the slot of said lever and is attached to said lever by said engagement pin, said case including a storage chamber for storing the shoe and a cushion member, the cushion member positioned between an inner surface of the storage chamber and the shoe, wherein the cushion member elastically presses the shoe against the side end face of the lever to engage the convex surface of the shoe with one of the first and second recesses.

2. The device of claim 1, wherein the movable plate lever includes a base portion adapted to be rotatably attached to a side of a vehicle door.

3. The device of claim 1, wherein the vehicle door is adapted to be stopped between an open and a closed position when the second recess engages the braking mechanism.

4. The device of claim 1, wherein the vehicle door is adapted to be stopped in an open position when the first recess engages the braking mechanism.

5. The device of claim 1, wherein the moveable plate lever includes a base portion adapted to be rotatably attached to a side of a vehicle door, and wherein said engagement pin is adapted to attach said case containing said braking mechanism and said lever to a vehicle body.

6. The device of claim 5, wherein the lever, the case, and the engagement pin are adapted to be disposed below said vehicle door.

* * * * *

UNITED STATES PATENT AND TRADEMARK OFFICE

CERTIFICATE OF CORRECTION

PATENT NO. : 6,176,040 B1
DATED : January 23, 2001
INVENTOR(S) : Noriyuki Sugihara It is certified that error appears in the above-identified patent and that said Letters Patent is hereby corrected as shown below:

Column 6,
Claim 3, line 25, "claim 1" should read -- claim 2 --; and
Claim 4, line 28, "claim 1" should read -- claim 2 --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*